US005215142A

United States Patent [19]

Ahrens

[11] Patent Number: 5,215,142

[45] Date of Patent: Jun. 1, 1993

[54] MULTIPLE MOLD WITH CHANGE-OVER FEATURE FOR HORIZONTAL CONTINUOUS CASTING

[76] Inventor: Max Ahrens, 4 Vista, Irvine, Calif. 92715

[21] Appl. No.: 822,746

[22] Filed: Jan. 21, 1992

[51] Int. Cl.[5] ..... B22D 11/10; B22D 11/14

[52] U.S. Cl. ..... 164/490; 164/440

[58] Field of Search ..... 164/490, 483, 440, 137

[56] References Cited

U.S. PATENT DOCUMENTS

| | | | |
|---|---|---|---|
| 4,425,961 | 1/1984 | Tromel | 164/440 |
| 4,714,105 | 12/1987 | Keutgen et al. | 164/440 X |
| 4,779,670 | 10/1988 | Koskinen et al. | 164/483 X |
| 4,799,533 | 1/1989 | Ahrens et al. | 164/440 X |

FOREIGN PATENT DOCUMENTS

| | | | |
|---|---|---|---|
| 2707533 | 8/1978 | Fed. Rep. of Germany | 164/440 |
| 1380854 | 3/1988 | U.S.S.R. | 164/440 |
| 2156253A | 10/1985 | United Kingdom | 164/440 |

*Primary Examiner*—J. Reed Batten, Jr.
*Attorney, Agent, or Firm*—Roy A. Ekstrand

[57] ABSTRACT

A horizontal continuous casting system includes a tundish having a refractory lining and supporting a quantity of molten metal therein. The tundish supports a slide gate shut-off device. A rotating drum supports a plurality of interchangeable casting molds and is operatively coupled to a hydraulic motor through a linear bearing support. The motor is operative to rotate the drum and interchange the casting molds during brief casting interruptions facilitated by the slide gate shut-off. Each interchangeable mold in the plurality of casting mold includes an indexing flange defining a plurality of index recesses. A clamp stand is positioned downstream of the rotating drum and casting molds and supports a plurality of expandable hydraulic cylinders having extending index pins which cooperate with the index recesses and mold flange to secure a casting flange in place during the casting operation. The casting molds may be interchanged by retracting the extending pins using the hydraulic cylinders and rotating the rotatable drum to move an exhausted or defective mold out of the casting system and replace it with a new or refurbished casting mold.

11 Claims, 2 Drawing Sheets

MULTIPLE MOLD WITH CHANGE-OVER FEATURE FOR HORIZONTAL CONTINUOUS CASTING

FIELD OF THE INVENTION

This invention relates generally to horizontal continuous casting and particularly to mold change-over processes used therein.

BACKGROUND OF THE INVENTION

The horizontal continuous casting process has provided substantial benefits in the metal fabricating arts and is particularly appreciated for its ability to produce extended length constant cross-section castings or billets which would be generally impractical if attempted using other more conventional casting systems. While the structures of horizontal continuous casting systems vary substantially, generally all include a large capacity insulated reservoir for molten metal referred to as a tundish. The most common tundish fabrication includes an interior lining of refractory material chosen for its extreme resistance to the high temperatures associated with metal casting. The tundish is further provided with an outlet orifice near the lower portion of the tundish and provision is made to couple a casting mold and communication with the tundish such that molten metal may be transferred from the tundish interior to the mold. Mold structures vary somewhat but generally all comprise elongated metal structures defining a central passage therethrough and are usually formed of a metal such as copper having a high heat transfer characteristic. The center mold passage is surrounded by a water cooled jacket which in turn is coupled to a supply of cooling water having sufficient flow to carry the heat from the mold passage during the casting process. The molten metal is introduced into the cooled mold and is solidified or frozen therein to form the casting. In most instances, a dummy or starter bar is inserted into the mold passage and coupled to a casting puller arrangement to initiate the casting process. As the process begins, the starter bar is withdrawn from the mold through the mold passage and the metal within the tundish is permitted to flow into the mold passage. Within the mold passage, the casting forms in a welded attachment to the starter bar. The casting pullers thereafter extract the casting formed within the mold in accordance with a predetermined motion profile in which the casting emerges from the mold and is continuously formed or cast as metal within the tundish flows into the casting mold to replace the withdrawn casting.

In most horizontal continuous casting systems, the motion profile used by the puller systems to extract the casting forming within the mold is a series of forward or outward motions interleaved with brief and relatively small reverse motion steps. The latter are generally provided to assure proper formation of the continuous casting. In many horizontal continuous casting systems, a slide gate is interposed between the tundish outlet and the casting mold to provide a shut-off valve mechanism. The most common slide gate includes a pair of ceramic plate members which may be interchanged. One ceramic plate defines an aperture therethrough while the other is completely closed defining no aperture. Closure of the slide gate is provided by inserting the plate having no aperture while opening of the slide gate is provided by inserting the plate having an aperture therein.

Ideally, it would be desirable to operate a horizontal continuous casting system in a virtually endless extended operation in which equilibrium is reached and casting takes place continuously and in which the supply of molten metal within the tundish is periodically replaced. Unfortunately, several factors limit the extent to which a horizontal continuous casting system may be operated in an uninterrupted manner. One of the most significant limitations upon the duration of horizontal continuous casting operation is the substantial wear imposed upon the continuous casting mold. Within the mold, a ceramic ring generally known as a break ring is used to interface the slide gate to the mold and is subject to substantial wear during the normal casting process. In addition, the mold itself is usually formed of a copper metal or the like which has a significant tendency to wear as the forming casting is drawn through the mold passage. Other factors such as breakdown or failure of the mold which compromise its integrity or safety also frequently force shutdown of continuous casting operations. In addition to mold problems, however, other factors within the horizontal continuous casting systems of the type to which all mechanical and electromechanical systems are subject, contribute to periodic shutdown of the casting operation.

A substantial number of problems arise when a horizontal continuous casting system is prematurely shutdown which have severe impact upon the economics of casting operation. Shutdown itself is accomplished relatively simply in systems having slide gate apparatus by the insertion of the apertureless ceramic plate which terminates the flow of molten metal into the mold. The problems associated with such shutdowns, however, are substantial. Almost immediately upon the termination of the casting process, the molten metal within the tundish begins to cool and approach its freezing temperature. This freezing problem is particularly critical in the tundish region near the slide gate itself. While practitioners may delay this freezing process somewhat through the use of high energy plasma torches or induction coils, the metal freezing within the slide gate area is virtually impossible to prevent and, in any extended shutdown, renders restarting of the casting operation impossible.

Thus, while horizontal continuous casting operations may survive brief interruptions of the casting process, any extended duration shutdown forces a complete termination of the casting operation. Thus, once the operator has determined that the interruption of casting operation will force a complete shutdown, the tundish must be completely emptied to prevent the slide gate area from freezing off and exacerbate the problems of restarting. In addition, the refractory lining of the tundish must be inspected and repaired in preparation for the next casting operation. The refractory lining within the tundish tend to form small cracks due to its ceramic character during the casting process. These cracks, in turn, become filled with molten metal as the tundish supply of molten metal is maintained. Upon shutdown and cooling, the molten metal within these cracks freezes to form metal "fins" extending into the refractory lining. These metal fins must be extracted from the refractory lining and the lining cracks patched using a repair material before the tundish is again used in the continuous operation. In addition, the ceramic material of the slide gate mechanism is subject to fatigue and cracking and thus must often be replenished and replaced before casting may be resumed.

The recognition by practitioners of the art of the severe economic impact of premature or undesired shutdown of casting operations has prompted practitioners to attempt the development of systems which maintain the molten metal within the tundish and which accomplish the restoration of the casting process with sufficient speed to avoid the freezing of molten metal within the tundish slide gate area and permit the restarting of the casting operation. Such systems have included providing heated tundishes and heated slide gate arrangements as well as systems intended to speed up the removal and replacement of a worn or failed casting mold. Unfortunately, however, most systems devised have been relatively ineffective and unsuccessful.

There remains, therefore, a need in the art for an improved horizontal continuous casting system which facilitates the rapid change-over of horizontal continuous casting molds and which avoids the complete termination of casting operations by permitting the casting operation to be restarted.

SUMMARY OF THE INVENTION

Accordingly, it is a general object of the present invention to provide an improved horizontal continuous casting system. It is a more particular object of the present invention to provide an improved horizontal continuous casting system which facilitates the rapid change-over of horizontal continuous casting molds. It is a still particular object of the present invention to provide an improved horizontal continuous casting system which facilitates mold change-over and restarting of the casting operation.

In accordance with the present invention, there is provided for use in a continuous casting system having a tundish for supporting a quantity of molten material defining a discharge opening and means for interrupting the flow of molten material therefrom, a multiple mold casting system comprises: a rotatable drum having a plurality of mold supports; a plurality of casting molds each defining respective mold passages therein; drive means for supporting and rotating the rotatable drum so as to bring a selected one of the plurality of casting molds to a casting position in which the mold passage thereof is aligned with the discharge opening; and clamping means operative upon the selected one of the casting molds to maintain the selected casting mold in the casting position.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
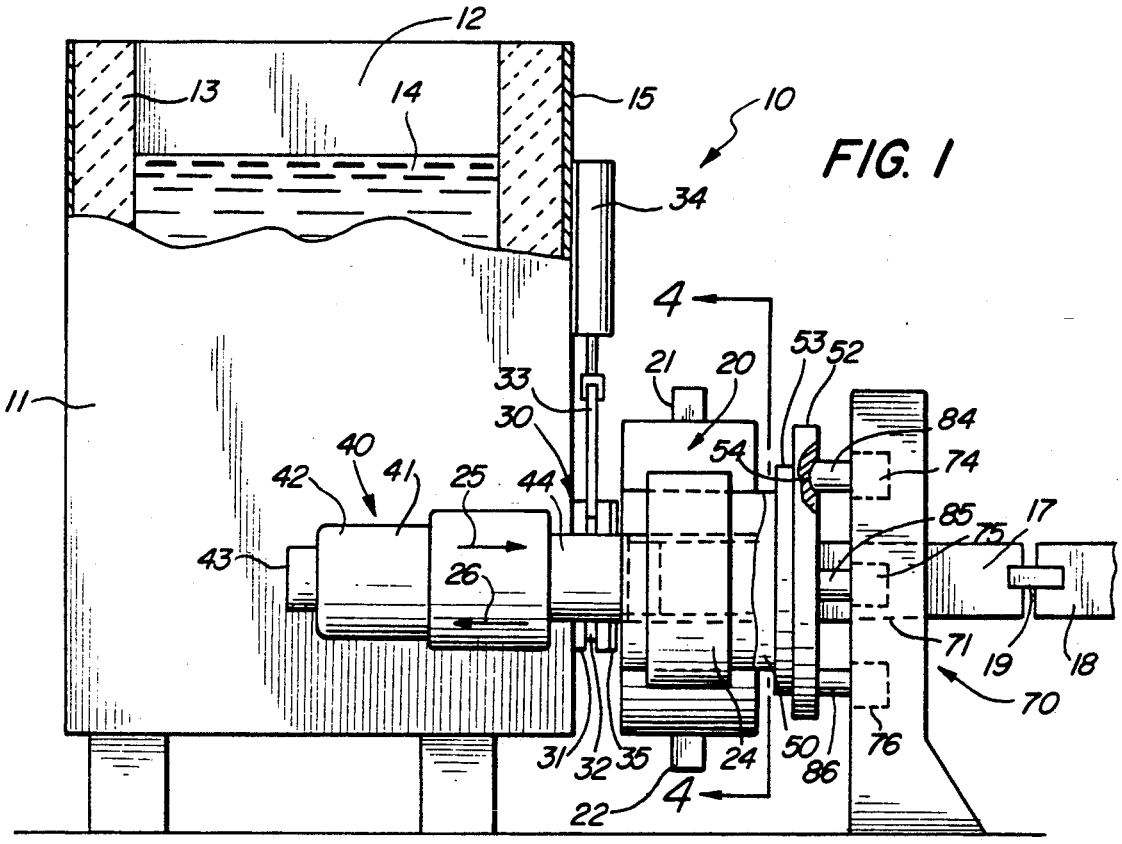
FIG. 1 sets forth a side elevation view of a horizontal continuous casting system constructed in accordance with the present invention.

FIG. 1 sets forth a partially sectioned side view of a horizontal continuous caster constructed in accordance with the present invention and generally referenced by numeral 10. Caster 10 includes a tundish 11 defining an interior cavity 12 which supports a refractory lining 13 therein. A quantity of molten metal 14 is received within interior cavity 12. Tundish 11 is constructed in accordance with conventional fabrication techniques and defines a front face 15 which supports a slide gate housing 31 and a slide gate cylinder 34. Slide gate housing 31 supports a plate 32 therein and an additional slide gate plate 33 is supported by and coupled to cylinder 34 Slide gate housing 31, cylinder 34 and movable plates 32 and 33 combine to form a conventional slide gate shut-off mechanism which is supported upon front face 15 by conventional attachment means (not shown) and which is generally referenced by numeral 30.

A rotating drum 20, constructed in accordance with the present invention, includes a pair of cooling water couplings 21 and 22 and is formed in a generally cylindrical shape. Rotating drum 20 includes a pair of mold supports 23 and 24 (the latter seen in FIG. 3) and is rotationally supported upon a drum shaft 44. Drum shaft 44 is received within a linear bearing 41 which is secured to tundish 11 by conventional fabrication techniques (not shown). A drive motor 42 in its preferred form includes a hydraulic motor having a sliding push-/pull spindle coupled to drum shaft 44 in accordance with conventional fabrication techniques by which hydraulic motor 42 may rotate shaft 44. An encoder 43, constructed in accordance with conventional fabrication techniques, is supported upon and coupled to hydraulic motor 42 and provides positional information relating to the rotational position of drum shaft 44. Other conventional mechanical devices such as locating pins or cam locks may be used to position drum shaft 44.

A pair of horizontal continuous casting molds 50 and 60 are supported upon rotating drum 20 by mold supports 23 and 24 respectively. Mold 60 is shown in broken section to reveal the structure of mold 50. Accordingly, mold 50 includes an interior mold passage 51 (better seen in FIG. 4) and supports a flange support 53 and an index flange 52. Index flange 52 defines a plurality of index recesses such as 54 equally spaced about index flange 52 and symmetrical with respect to mold passage 51. Index recess 54 is shown in broken section for purposes of illustration and it should be understood that the remaining index recesses are similar to recess 54. Similarly, and as is better seen in FIG. 3, mold 60 defines a flange support 63 and a index flange 62 and is generally similar to mold 50. While not shown in FIGS. 1 through 4, it should be understood that in accordance with conventional fabrication techniques, molds 50 and 60 each include a plurality of coolant passages surrounding mold passages 51 and 61 (not shown).

A clamp stand 70 defines a center passage 71 and supports a plurality of hydraulic clamping cylinders 74 through 77. Cylinders 74 through 77 include corresponding extending pins 84 through 87 which, in accordance with conventional fabrication techniques, are expandable outwardly from clamp stand 70 toward index flange 52 and retractable therefrom using hydraulic operation of cylinders 74 through 77. Cylinders 74 through 77 are positioned within clamp stand 70 in alignment with recesses of index flange 52 such that pins 84 through 87 when extended are received within recesses. Thus, in accordance with an important aspect of the present invention, hydraulic cylinders 70 through 74 provide a plurality of symmetrically distributed lateral forces against index flange 52 while the cooperation of index recesses and extendable pins 84 through 87 provide alignment and indexing of flange 52.

In operation, hydraulic motor 42 is operative to rotate drum shaft 44 and rotating drum 20 to align mold 50 with slide gate 30 while hydraulic clamping cylinders 74 through 77 are actuated so as to withdraw extending pins 84 through 87 to a retracted position within clamp stand 70. Once rotating drum 20 has rotated to the correct position to properly align casting mold 50 with slide gate 30, hydraulic motor 42 ceases operation and cylinders 74 through 77 are actuated so as to extend pins 84 through 87 outwardly from clamp stand 70 and engage recesses respectively within index flange 52. The expanding force exerted upon index flange 52 by cylinders 74 through 77 provides a compressive force which forces casting mold 50 against seal 35 interposed between slide gate housing 31 and the end portion of mold 50 to provide a reliable seal therebetween. Once mold 50 is properly aligned with slide gate 30, a starter bar 17 supported by a coupling 19 and a puller 18 is inserted through passage 71 of clamp stand 70 and mold passage 51 of mold 50 to extend into slide gate housing 31

Thereafter, in accordance with conventional operation, cylinder 31 of slide gate 30 is energized driving plate 33 into housinq 31 and ejecting plate 32. In the position shown in FIG. 1 in which it is assumed that horizontal continuous caster 10 is prepared for the initiation of the casting process, plate 32 within housing 31 of slide gate 30 is a nonapertured plate providing the desired closure of tundish 11. To open tundish 11, plate 33 is provided with an aperture therethrough such that the insertion of plate 33 within housing 31 provides a flow passage through slide gate 30 into mold 50 for molten metal 14 and the initiation of the continuous casting process. In further accordance with conventional casting techniques, the flowing molten metal within mold 50 welds to starter bar 17 afterwhich puller 18 and conventional puller mechanisms (not shown) are operative to begin withdrawing starter bar 17 and commence the casting process.

Figure 3:
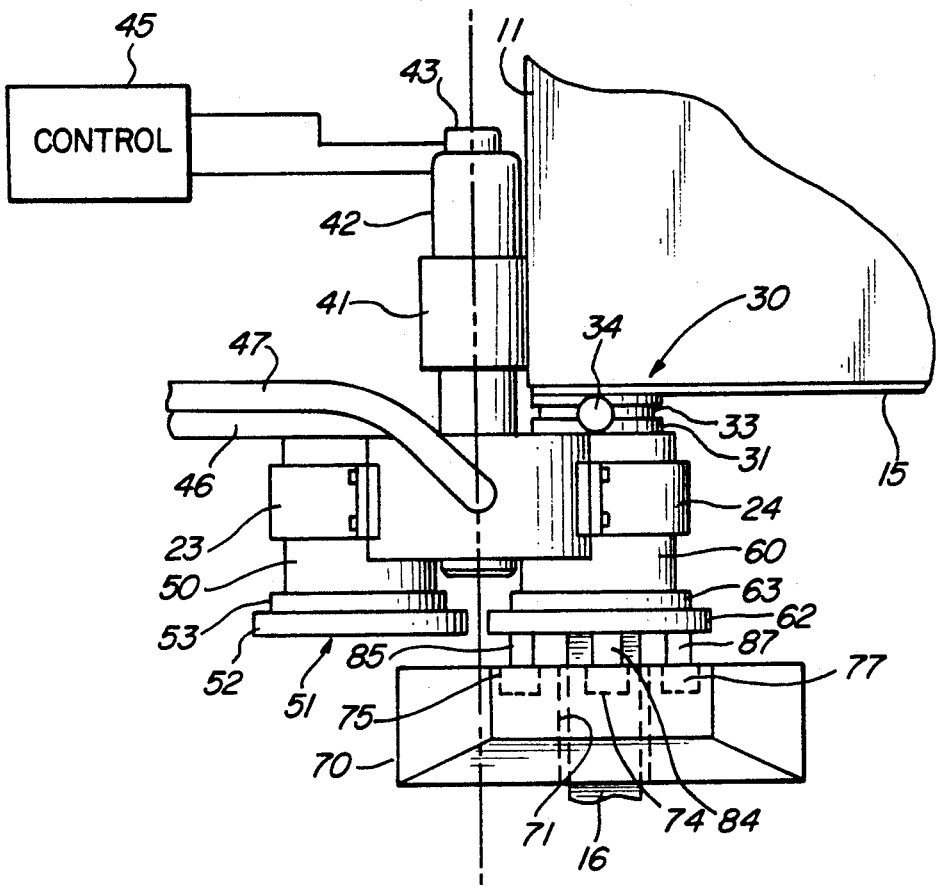
FIG. 3 sets forth a top view of the present invention horizontal continuous casting system.

Once casting begins, the casting process of caster 10 is carried forward in accordance with generally conventional operation to form an extending casting 16 (seen in FIG. 3). This casting process continues so long as mold 50 continues to function properly and the remainder of casting system 10 is operative. Periodically, the supply of molten metal 14 within tundish 11 may be replenished with additional molten metal to further continue the casting process. At some point, however, the operation of mold 50 becomes subject to the above-described deterioration and wear and the casting process must be interrupted to terminate the use of mold 50. To facilitate the removal of mold 50, a nonapertured slide gate plate is positioned in the manner shown for plate 33 and cylinder 34 is energized driving plate 33 into housing 31 and terminating the flow of molten metal from tundish 11 into mold 50.

In accordance with an important aspect of the present invention, mold 50 may be quickly removed from tundish 11 and a fresh mold 60 may replace mold 50 to permit the rapid resumption of the casting process. Specifically, upon closure of slide gate 30, casting 16 is withdrawn from mold passage 51 afterwhich hydraulic cylinders 74 through 77 are operative to withdraw indexing pins 84 through 87 from recesses respectively within indexing flange 52. Concurrently, hydraulic motor 42 is actuated to move drum shaft 44 linearly in the direction indicated by arrow 25 opening seal 35 and freeing mold 50 from slide gate 30. Thereafter, hydraulic motor 42 is actuated to rotate rotating drum 20 about drum shaft 44 to rotate mold 50 out of alignment with slide gate 30 and to replace mold 50 with a fresh mold 60. The interchange of molds 50 and 60 is shown in FIG. 3. Once mold 60 is properly ligned with slide gate 30, hydraulic cylinders 74 through 77 are again actuated extending indexing pins 84 through 87 into recesses 94 through 97 respectively of indexing flange 62. The extension of pins 84 through 87 forces mold 60 into engagement with slide gate 30 and completes the installation of mold 60. A starter bar such as starter bar 17 is inserted into mold passage 61 in the manner described above afterwhich slide gate 30 is opened by placing an apertured slide gate plate in the position shown for plate 33 and energizing cylinder 34. Cylinder 34 drives the apertured plate into housing 31 and initiates the flow of molten metal into mold passage 61 of mold 60. Thereafter, the cooling action of mold 60 begins the formation of the casting within mold passage 61 producing the beginnings of a casting such as casting 16 (seen in FIG. 3) which are welded to starter bar 17 and which are progressively withdrawn from mold 60 in accordance with the above-described casting operation.

It should be noted that the removal of exhausted mold 50 and its replacement by a fresh mold 60 is, in accordance with the present invention, carried forward very quickly and the complete installation of fresh mold 60 is finished prior to the above-described freezing of the tundish area around slide gate 30 thereby avoiding the need for shutdown of the casting process and permitting the restarting of casting operations. Thus, the above-described economic impact of mold replacement is not felt and considerable economy of operation is achieved by permitting tundish 11 to be repeatedly refilled and casting system 10 to be continuously operated for an extended period of time well in excess of the usable life of the casting mold.

It should be apparent to those skilled in the art that once mold 60 has been switched with exhausted mold 50 in the above-described operation, mold 50 may be removed from rotational drum 20 and serviced in accordance with conventional refurbishing techniques and once refurbished, may be replaced upon rotating drum 20 to be available for reinstallation once mold 60 has experienced excessive wear and requires replacement. In the alternative, it will be equally apparent to those skilled in the art that mold 50 may be completely removed from rotating drum 20 and a third mold which is either new or restored and ready for operation may be fitted within mold support 23. In either event, the dramatic increase in system productivity and economy of operation will be clear to those skilled in the art.

Figure 2:
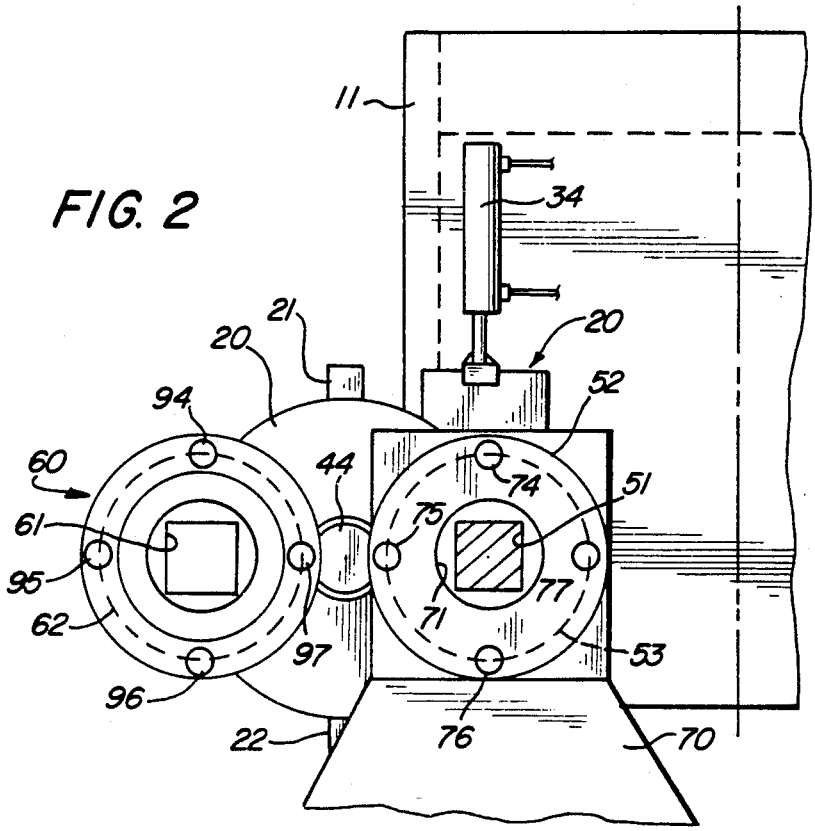
FIG. 2 sets forth a front view of the present invention horizontal continuous casting system.

FIG. 2 sets forth a front view of horizontal continuous caster 10 prior to the above-described interchange of molds 50 and 60. As described above, tundish 11 supports a slide gate 30 having a housing 31 (seen in FIG. 1), a cylinder 34 and a plate 33. Tundish 11 further supports a drum support 40 (seen in FIG. 1) having an extending drum shaft 44. The latter receives a rotating drum 20 having a pair of coolant water couplings 21 and 22 on opposite sides thereof. Rotating drum 20 includes a pair of mold supports 23 and 24 (seen in FIG. 3) on opposite sides of drum shaft 44. A clamp stand 70 supports a plurality of expandable hydraulic cylinders 74 through 77 in a symmetrical arrangement about a center passage 71 defined within clamp stand 70. A mold 50 defines a mold passage 51 aligned with passage 71 of clamp stand 70 and an indexing flange 52 and support flange 53 in concentric arrangement set forth above. An elongated casting 16 is shown in section view and extends outwardly from mold passage 51 and mold 50.

In accordance with the present invention, an additional casting mold 60 is received and secured within a mold support 24 (seen in FIG. 3) and includes a casting passage 61 together with an index flange 62 and a support flange 63. Flange 62 defines a plurality of indexing recesses 94 through 97 and is identical to flange 52 and recesses 74 through 77 of mold 50.

In the position shown in FIG. 2, the above-described casting operation in which a casting 16 is continuously formed within mold 50 is carried forward. In accordance with the present invention, the above-described switching of molds 50 and 60 may be carried forward by rotating rotatable drum 20 in the manner indicated in an operation which rotates mold 50 away from slide gate 30 while rotating mold 60 into alignment with slide gate 30. As is also mentioned above, during this interchange of molds, hydraulic cylinders 74 through 77 are contracted to provide sufficient clearance for flange 52 to move with respect to pins 84 through 87 and to permit flange 62 of mold 60 to move into a position of alignment with slide gate 30.

It will be apparent to those skilled in the art that while FIGS. 1 through 4 set forth an embodiment of the present invention in which a pair of interchangeable casting molds are rotatably supported upon rotating drum 20, the present invention system may be used employing a greater number of interchangeable molds such as three interchangeable molds placed in a triangular arrangement upon a rotating drum such as drum 20. It will be further apparent to those skilled in the art that an even greater number of casting molds may be supported in such an arrangement without departing from the spirit and scope of the present invention. In addition, in its preferred form, the present invention is shown having casting molds 50 and 60 symmetrically disposed about drum shaft 44. However, it will be apparent to those skilled in the art that, in certain situations, it may be desirable to use a nonsymmetrical arrangement and it will be understood that such a nonsymmetrical arrangement of casting molds does not depart from the spirit and scope of the present invention. It should be noted that molds 50 and 60 may be formed to cast different cross-sectioned castings and profiles. Thus, the present invention system also facilitates rapid change to different shaped cast product.

FIG. 3 sets forth a top view of horizontal continuous caster 10 following the exchange of molds 50 and 60 by the above-described operation. Tundish 11 includes a front face 15 supporting a slide gate 30 having a housing 31, a pair of movable plates 33 and 32 and an actuating cylinder 34. A linear bearing 41 and motor 42 are operatively coupled to a drum shaft 44 forming an assembly which is secured to tundish 11 by conventional attachment means (not shown). Motor 42 further supports an encoder 43 operatively coupled to motor 42. A control unit 45 is operatively coupled to motor 42 and encoder 43. A rotating drum 20 includes a pair of coolant couplers 21 and 22 (the latter seen in FIG. 1) which are further coupled to a source of cooling water supply (not shown) by a pair of hose connections 46 and 47. A pair of motor supports 23 and 24 are secured to rotating drum 20 and support respective casting molds 50 and 60 respectively. Mold 50 includes a flange support 53, an indexing flange 52 and a mold passage 51 extending therethrough. Similarly, mold 60 includes a flange support 63, an indexing flange 62 and a mold passage 62 (seen in FIG. 4).

A clamp stand 70 supports a plurality of expandable hydraulic cylinders 74 through 77 symmetrically arranged about a center passage 71. A casting 16 is formed within mold 60 and extends outwardly therefrom through passage 71 and is coupled to conventional casting puller apparatus (not shown) to perform the above-described horizontal continuous casting operation. While not shown in FIGS. 1 through 4, it should be understood that hydraulic cylinders 74 through 75 are coupled to a source of hydraulic operative power in accordance with conventional fabrication techniques. Thus, hydraulic cylinders 74 through 77 support corresponding indexing pins 84 through 87 which may be selectively extended outwardly in the position shown in FIG. 3 or withdrawn toward clamp stand 70 by the application of the appropriate hydraulic power flow in accordance with conventional fabrication techniques. The expansion of cylinders 74 through 77 produces an outward force upon indexing pins 84 through 87 which are received within index recesses 94 through 97 of flange 62 to secure mold 60 in the position shown. It should be noted that the rotation of rotating drum 20 from the position shown in FIG. 2 to that shown in FIG. 3 produces an inversion of mold 60 and thus flange 62 is similarly inverted. However, the symmetrical positioning of recesses 94 through 97 and cylinders 74 through 77 maintains the alignment of pins 84 through 87 with recesses 94 through 97 notwithstanding the inversion thereof which places recess 94 in alignment with pin 86, recess 95 in alignment with pin 87, recess 96 in alignment with pin 84, and recess 97 in alignment with pin 85. Nevertheless, the symmetry assures that indexing pins 84 through 87 are received within aligned recesses on flange 62 permitting mold 60 to be forced against housing 31 of slide gate 30 in a sealing engagement which is maintained during the casting operation.

As is also mentioned above, it will be apparent to those skilled in the art that mold 50 may be refurbished and replaced upon rotating drum 20 to await installation upon the wear of mold 60 or be replaced entirely. Thus, once mold 60 has experienced an excessive amount of wear, rotating drum 20 may again be rotated in either direction once slide gate 30 is closed and hydraulic cylinders 74 through 77 are contracted thereby returning rotating drum 20 and molds 50 and 60 to the position originally shown in FIG. 1.

Figure 4:
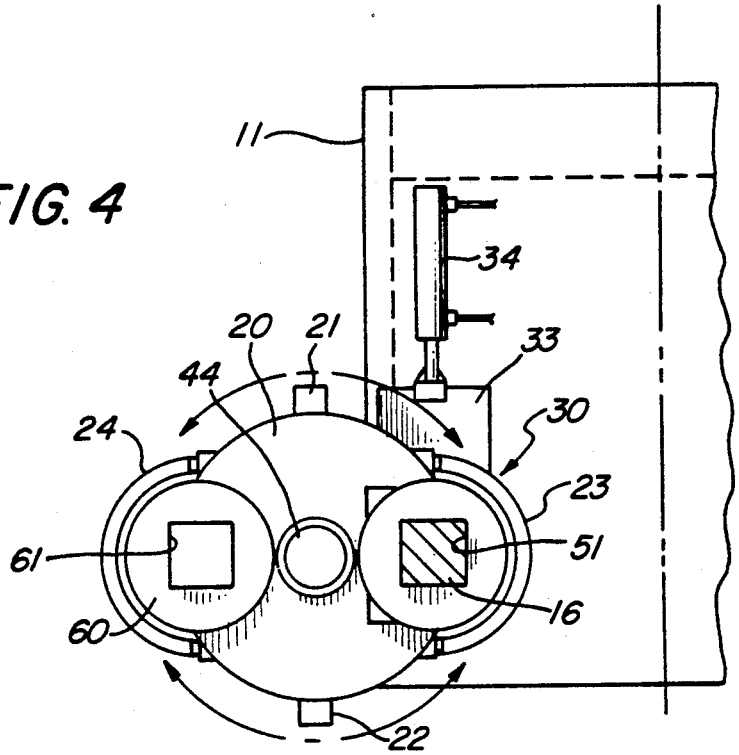
FIG. 4 sets forth a section view of the present invention horizontal continuous casting system taken along section line 4—4 in FIG. 1.

FIG. 4 sets forth a section view of the present invention horizontal continuous caster taken along section lines 4—4 in FIG. 1. Caster 10 is shown in FIG. 4 prior to the rotation of drum 20 described above. Thus, caster 10 includes a tundish 11 supporting a slide gate 30 having a cylinder 34 and a movable plate 33. A rotating drum 20 is supported by a drum shaft 44 in the above-described rotational support. Drum 20 further includes a pair of water couplings 21 and 22. Drum 20 further defines a pair of mold supports 23 and 24 which receive a corresponding pair of casting molds 50 and 60. Mold 50 defines a mold passage 51 within which a casting 16 is formed during the above-described casting operation. Correspondingly, mold 60 includes a mold passage 61.

It should be noted that coolant water couplings 21 and 22 are shown as an opposed pair of water couplings for rotating drum 20. However, it will be apparent to those skilled in the art that additional numbers and different arrangements of coolant water couplers may be utilized in the present invention system without departing from the spirit and scope of the present invention. It will be equally apparent to those skilled in the art that the ease with which the present invention system provides for replacement and repair of the casting mold not in use (mold 60 in FIG. 4) permits the nearly continuous operation of the present invention system despite substantial numbers of mold failures due to the ability of the present invention system to maintain an additional mold in a new or refurbished condition which is available for rapid substitution within the casting system. Each time the present invention system is utilized to remove one mold and insert the other, it will be apparent to those skilled in the art that the removed exhausted mold is immediately available for replacement or repair. As a result, the casting systems reliability is much less dependent upon the life of the casting molds including the highly critical ceramic break ring described above.

What has been shown therefore is a multiple mold horizontal continuous casting system having a novel mold change-over feature which facilitates the rapid interchange of an exhausted mold for a repaired or replenished mold with such speed that the casting operation is interrupted briefly and may be resumed before metal freeze occurs in the slide gate area of the tundish. Thus, the anticipated time between casting terminations and repair shutdowns for the refurbishing of the tundish is greatly extended due to the removal of the casting system's high susceptibility and dependence upon mold reliability and wear life.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in a continuous casting system having a tundish for supporting a quantity of molten material defining a discharge opening and means for interrupting the flow of molten material therefrom, a multiple mold casting system comprising:

a rotatable drum having a plurality of mold supports;

a plurality of casting molds each defining respective mold passages therein;

drive means for supporting and rotating said rotatable drum so as to bring a selected one of said plurality of casting molds to a casting position in which said mold passage thereof is aligned with said discharge opening; and clamping means operative upon said selected one of said casting molds to maintain said selected casting mold in said casting position.

2. A multiple mold casting system as set forth in claim 1 wherein said plurality of mold supports are symmetrically arranged with respect to said drive means.

3. A multiple mold casting system as set forth in claim 2 wherein each of said casting molds includes an extending flange member cooperating with said clamping means.

4. A multiple mold casting system as set forth in claim 3 wherein each of said extending flanges generally encircle said mold of their respective molds.

5. A multiple mold casting system as set forth in claim 4 wherein said extending flanges each define a plurality of indexing recesses and wherein said clamping means includes a plurality of expandable cylinders having extendable index pins, said pins being received partially into said recesses when said cylinders are expanded.

6. A multiple mold casting system as set forth in claim 5 wherein said indexing recesses are generally symmetrical about the center line of said casting mold.

7. A multiple mold casting system as set forth in claim 6 wherein pluralities of mold supports and casting molds are both two.

8. A multiple mold casting system as set forth in claim 7 wherein said drive means includes a linear bearing.

9. A multiple mold casting system as set forth in claim 1 wherein said casting molds define differently shaped and sized casting passages therethrough.

10. For use in a continuous casting system having a supply of molten material, an output opening for discharge of said material and a shut-off valve, casting mold change-over means comprising:

means for supporting a first mold at a first rotational position in operative alignment with said output opening;

means for supporting a second mold at a second rotational position out of operative alignment with said output opening;

means for securing either said first or second mold at said first rotational position in operative communication with said output opening;

means for releasing said first mold;

means for rotationally interchanging said first and second molds; and said shut-off valve being opened to begin casting and closed prior to actuation of said means for releasing and means for rotationally interchanging and opened again once said means for securing is operative upon said second mold.

11. In a method of continuously casting using a continuous casting system having a supply of molten material, an output opening for discharge of said material and a shut-off valve, a method of casting mold change-over comprising the steps of:

supporting a first mold at a first rotational position in operative alignment with said output opening;

supporting a second mold at a second rotational position out of operative alignment with said output opening;

securing said first mold at said first rotational position in operative communication with said output opening;

opening said shut-off valve to flow said molten material into said first mold in a casting process;

closing said shut-off valve to interrupt said flow;

releasing said first mold;

rotationally interchanging said first and second molds;

securing said second mold in said first rotational position in operative communication with said output opening; and opening said shut-off valve to flow said molten material into said second mold in a casting process.

* * * * *